US010938132B1

(12) United States Patent
Chen

(10) Patent No.: US 10,938,132 B1
(45) Date of Patent: Mar. 2, 2021

(54) PATCH ELECTRICAL CONNECTOR

(71) Applicant: Xiamen Ghgm Electric Co., Ltd., Xiamen (CN)

(72) Inventor: Bingshui Chen, Xiamen (CN)

(73) Assignee: XIAMEN GHGM ELECTRIC CO., LTD., Xiamen (CN)

( * ) Notice: Subject to any disclaimer, the term of this patent is extended or adjusted under 35 U.S.C. 154(b) by 0 days.

(21) Appl. No.: 16/669,491

(22) Filed: Oct. 30, 2019

(30) Foreign Application Priority Data

Aug. 30, 2019 (CN) ..... 2019 1 0826509

(51) Int. Cl.
*H01R 12/51* (2011.01)
*H01R 13/41* (2006.01)
*H01R 12/57* (2011.01)

(52) U.S. Cl.
CPC ..... *H01R 12/515* (2013.01); *H01R 12/57* (2013.01); *H01R 13/41* (2013.01)

(58) Field of Classification Search
CPC ..... H01R 12/57; H01R 13/41; H01R 13/415; H01R 13/10; H01R 13/11; H01R 13/14; H01R 13/112; H01R 13/115
See application file for complete search history.

(56) References Cited

U.S. PATENT DOCUMENTS 5,827,089 A * 10/1998 Beck, Jr. ..... H01R 12/7029 439/567
6,053,763 A * 4/2000 Brennan ..... H01R 43/205 439/491
6,053,767 A * 4/2000 Copper ..... H01R 12/7029 439/567
6,328,600 B1 * 12/2001 Fujiki ..... H01R 12/57 439/570
6,547,608 B2 * 4/2003 Sato ..... H01R 13/11 439/851
8,328,586 B2 * 12/2012 Bies ..... H01R 4/4836 439/725
9,543,682 B2 * 1/2017 Jin ..... H01R 4/4836
10,355,386 B2 * 7/2019 Soudy ..... H01R 13/41

* cited by examiner

*Primary Examiner* — Oscar C Jimenez

(57) ABSTRACT

The present disclosure provides a patch electrical connector, which comprises a housing, a conductive clip and a second weld leg. The housing has at least one mounting cavity provided therein. The number of conductive clip matches the number of the mounting cavity, and the conductive clip is adapted to the mounting cavity. The conductive clip comprises a conductive seat provided in the mounting cavity, at least one pair of clamping pieces electrically connected to the conductive seat, and a first weld leg electrically connected to the conductive seat and welded to the PCB board. The second weld leg has one end welded to the PCB board and the other end disposed in the housing. A wire or male connector is insertable into the mounting cavity and clamped to one pair of the clamping pieces to enable electric communication with the PCB.

7 Claims, 7 Drawing Sheets

PATCH ELECTRICAL CONNECTOR

CROSS-REFERENCE TO RELATED APPLICATIONS

The present application claims the benefit under 35 U.S.C. § 119 of China Patent Application No. 2019108265094, filed on Aug. 30, 2019 in the China National Intellectual Property Administration, the content of which is hereby incorporated by reference.

TECHNICAL FIELD

The present disclosure relates to the technical field of connectors, and in particular to patch electrical connectors.

BACKGROUND

A patch electrical connector is a connector that is electrically connected to the printed circuit board ("PCB") by welding. A wire or male connector can be electrically connected to the PCB through the electrical connector.

At present, the patch electrical connector generally includes a housing and a conductive clip, and the conductive clip is directly welded to the PCB. In the prior art, since the welding portion on the PCB cannot be too large, the patch electrical connector usually cannot be firmly fixed on the PCB board, and the patch electrical connector may be shaken or even detached during use.

SUMMARY

The present disclosure provides a patch electrical connector that can be stably disposed on the PCB.

The present disclosure provides a patch electrical connector for electrical connection to a PCB board. The patch electrical connector can comprise a housing having at least one mounting cavity provided therein, a conductive clip provided in a same number as that of the mounting cavity, and adapted to the mounting cavity. The conductive clip can comprise a conductive seat provided in the mounting cavity, at least one pair of clamping pieces electrically connected to the conductive seat, and a first weld leg electrically connected to the conductive seat and welded to the PCB board. A second weld leg can have one end welded to the PCB board and another end disposed in the housing.

A wire or male connector can be inserted into the mounting cavity and clamped to one pair of the clamping pieces to enable electric communication with the PCB.

The conductive seat can comprise an intermediate section and a pair of engaging sections electrically connected to two sides of the intermediate section. The engaging sections can be used for engagement with the housing, and the clamping pieces can be electrically connected to the engaging sections.

The conductive clip can comprise a support protrusion provided at the engaging section or the intermediate section and located below the clamping pieces.

The engaging section can be provided with a first engaging portion having a teeth shape. The second weld leg can be provided with a second engaging portion having a teeth shape, and both the conductive clip and the second weld leg can be engaged with the housing.

The second weld leg can have a U-shaped geometry, and the housing can be provided with a connecting groove adapted to the second weld leg. The second weld leg can be laterally placed in the connecting groove.

The first weld leg and the second weld leg can be arranged one behind the other.

End sections of one pair of the clamping pieces can be respectively curved toward each other.

The patch electrical connector of the present disclosure has a simple structure and strong connection with the PCB board. The conductive clip can include a conductive seat, clamping pieces, and a first weld leg. The conductive seat can be firmly disposed in the mounting cavity via engagement therewith, and the first weld leg can be electrically connected to the conductive seat and the PCB board respectively to ensure electrical connection between the conductive clip and the PCB board. The conductive clip can be made of a non-conductive material, such as plastic. In addition, the patch electrical connector of the present disclosure can have a second weld leg, one end of which is welded to the PCB and another end is connected to the housing. The second weld leg can strengthen the connection between the patch electrical connector and the PCB. The patch electrical connector can ensure a more stable connection between the patch electrical connector and the PCB board.

In a specific implementation, the first weld leg and the second weld leg may be arranged accordingly, such as one after the other, or side by side, etc., so that the patch electrical connector can be firmly connected to the PCB board. In addition, in the present case, connection between the patch electrical connector and the PCB board is realized via only the first weld leg and the second weld leg, and the welding joints of the first weld leg or the second weld leg and the PCB board are welding seams instead of a wide range of surface connections. The area of the weld is greatly reduced while a secure connection can be ensured, thereby facilitating the arrangement of the electronic configuration on the PCB.

The patch electrical connector of the present disclosure can be firmly connected to the PCB board while ensuring a simple structure, and therefore has good practicability.

BRIEF DESCRIPTION OF THE DRAWINGS

In order to more clearly illustrate the technical solutions of the embodiments of the present disclosure, the drawings used in the embodiments will be briefly described below. It should be understood that the drawings show only certain embodiments of the present disclosure, and therefore should be seen as a limitation on the scope, and those skilled in the art can obtain other related drawings according to these drawings without any inventive work.

DETAILED DESCRIPTION OF EMBODIMENTS

Figure 1:
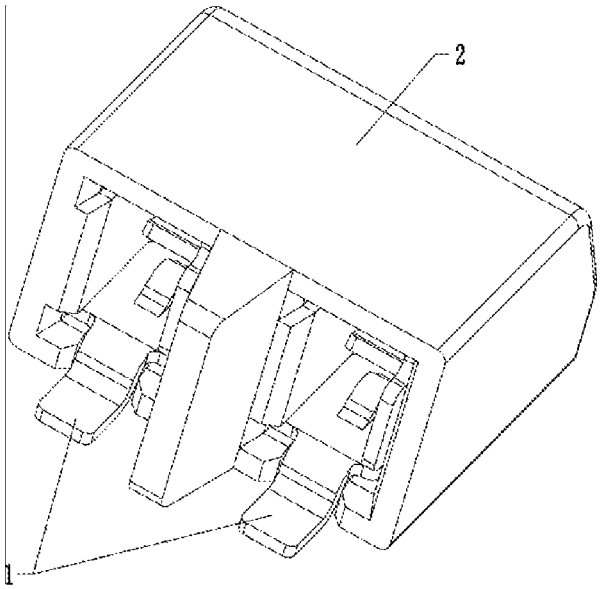
FIG. 1 is a first isometric view of a patch electrical connector of a first embodiment of the present disclosure.

The embodiments of the present disclosure will be clearly and completely described in conjunction with the drawings of the embodiments of the present disclosure. Apparently, what is described are some but not all of the embodiments of the present disclosure. All other embodiments obtained by a person of ordinary skill in the art based on the embodiments of the present disclosure without creative efforts are within the scope of the present disclosure. Therefore, the following detailed description of the embodiments of the present disclosure are not intended to limit the scope of the present disclosure, but to explain the selected embodiments of the present disclosure. All other embodiments obtained by a person of ordinary skill in the art based on the embodiments of the present disclosure without creative efforts are within the scope of the present disclosure.

In the description of the present disclosure, it is to be understood that the orientational or positional relationships indicated by the terms "center", "longitudinal", "transversal", "length", "width", "thickness", "upper", "lower", "front", "rear", "left", "right", "vertical", "horizontal", "top", "bottom", "inside", "outside", "clockwise", "counterclockwise", etc. are based on the orientation or positional relationship shown in the drawings, are merely for the convenience of describing the present disclosure and simplifying the description, and do not indicate or imply that the device or component referred to must have a specific orientation or be constructed and operated in a specific orientation. Therefore, it should not be construed as limiting the present disclosure.

Moreover, the terms "first" and "second" are used for descriptive purposes only and are not to be construed as indicating or implying a relative importance or implicitly indicating the number of technical features indicated. Thus, features defining "first" and "second" may include one or more of the features either explicitly or implicitly. In the description of the present disclosure, the meaning of "a plurality" is two or more unless specifically defined otherwise.

In the present disclosure, the terms "install", "connected", "connect", "fix" and the like shall be understood broadly. For example, the connection may be a fixed connection or a detachable connection or integration; may be a mechanical connection or an electrical connection; may be directly connected, may be indirectly connected through an intermediate medium, or may be an internal communication of two elements or the interaction of two elements, unless explicitly stated and defined otherwise. For those skilled in the art, the specific meanings of the above terms in the present disclosure can be understood based on specific situations.

In the present disclosure, when a first feature is described to be "on" or "under" a second feature, situations may include direct contact of the first and second features, and may also include indirect contact of first and second features through another feature therebetween, unless otherwise specifically defined and defined. Moreover, when a first feature is described to be "over", "above" and "on" the second feature, situations include that the first feature is directly not directly above the second feature, or that the first feature is merely located higher than the second feature. When a first feature is described to be "under", "below" and "down" the second feature, situations include that the first feature is directly or not directly below the second feature, or that the first feature is merely located lower than the second feature.

The present disclosure will be further described in detail below with reference to the accompanying drawings and specific embodiments.

First Embodiment

As shown in FIG. 1 to FIG. 4, in one embodiment, a patch electrical connector, which can be electrically connected to a PCB board, can include a housing 2 having at least one mounting cavity 4 provided therein, and a conductive clip 1 adapted for each of the at least one mounting cavity 4. The conductive clip 1 can comprise a conductive seat 8 provided in the mounting cavity 4, at least one pair of clamping pieces 5 electrically connected to the conductive seat 8, and a first weld leg 7 electrically connected to the conductive seat 8 and welded to the PCB board. A second weld leg 3 can have one end welded to the PCB board and another end disposed in the housing 2.

A wire or male connector can be inserted into the mounting cavity 4 and clamped to one pair of the clamping pieces 5 to enable electric communication with the PCB. The male connector can refer to a terminal that can be electrically connected to the patch electrical connector, which is a conventional device in the art and will not be described herein.

Figure 2:
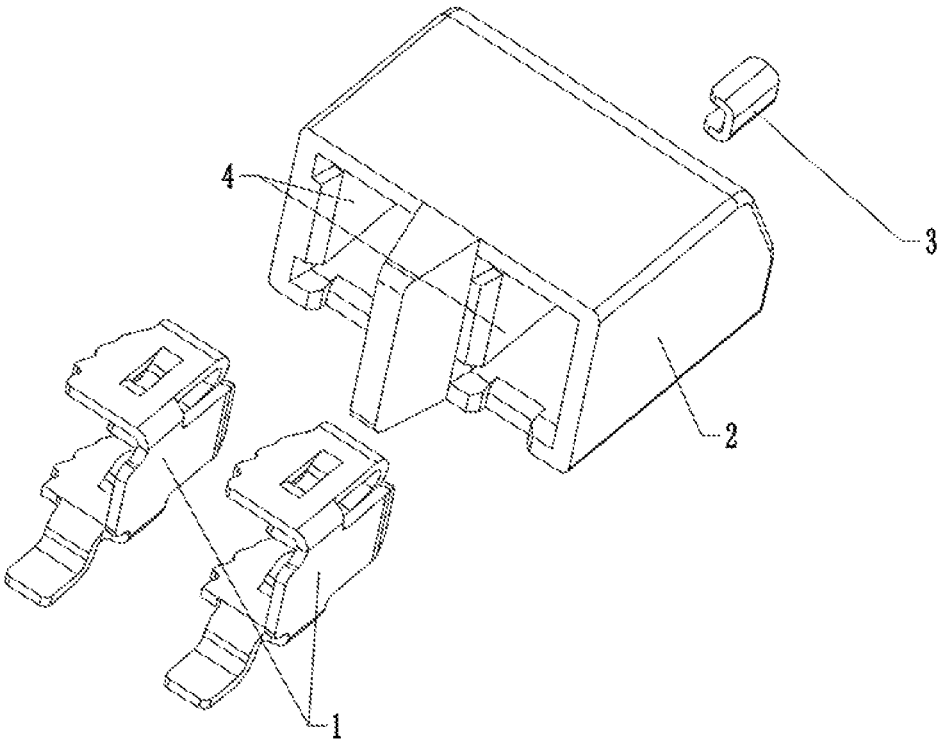
FIG. 2 is an exploded view of a patch electrical connector of the first embodiment of the present disclosure.
Figure 3:
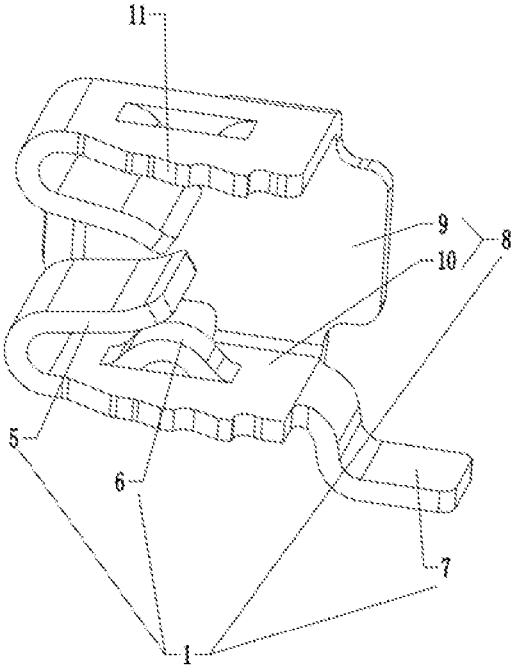
FIG. 3 is an isometric view of the conductive clip of the first embodiment of the present disclosure.

The patch electrical connector of the embodiment is a simple structure and ensures strong connection to the PCB board. As shown in FIG. 2 and FIG. 3, the conductive clip 1 can include a conductive seat 8, clamping pieces 5, and a first weld leg 7. The conductive seat 8 can be firmly disposed in the mounting cavity 4 by engaging or the like. The first weld leg 7 can electrically connect the conductive seat 8 and the PCB board to ensure electrical connection between the conductive clip 1 and the PCB board. The conductive clip 1 can generally be made of a non-conductive material such as plastic. In addition, the patch electrical connector of the present disclosure can have a second weld leg 3, one end of which is welded to the PCB and another end is connected to the housing 2. The second weld leg 3 can strengthen the connection between the patch electrical connector and the PCB. The patch electrical connector of the present disclosure can ensure a more stable connection between the patch electrical connector and the PCB board.

In a specific implementation, the first weld leg 7 and the second weld leg 3 may be arranged accordingly, such as one after the other, or side by side, etc., so that the patch electrical connector can be firmly connected to the PCB board. In addition, in the present case, connection between the patch electrical connector and the PCB board is realized via only the first weld leg 7 and the second weld leg 3, and the welding joints of the first weld leg 7 or the second weld leg 3 and the PCB board are welding seams instead of a wide range of surface connections. The area of the weld can be greatly reduced while a secure connection can be ensured, thereby facilitating the arrangement of the electronic configuration on the PCB.

As shown in FIG. 2 and FIG. 3, in the embodiment, the conductive seat 8 has a U-shaped geometry, and the conductive seat 8 can include an intermediate portion 9 and a pair of engaging sections 10 electrically connected to the two sides of the intermediate portion 9, respectively. The engaging sections 10 are used for engagement onto the housing 2, and the clamping pieces 5 are electrically connected to the engaging sections 10. The engaging sections 10 are provided with first engaging portions 11. The first engaging portions 11 have a convex teeth structure disposed on the engaging sections 10, and the first engaging portions 11 of the convex teeth structure can be well engaged with the housing 2 so that the conductive clip 1 can be firmly mounted in the mounting cavity 4.

Figure 4:
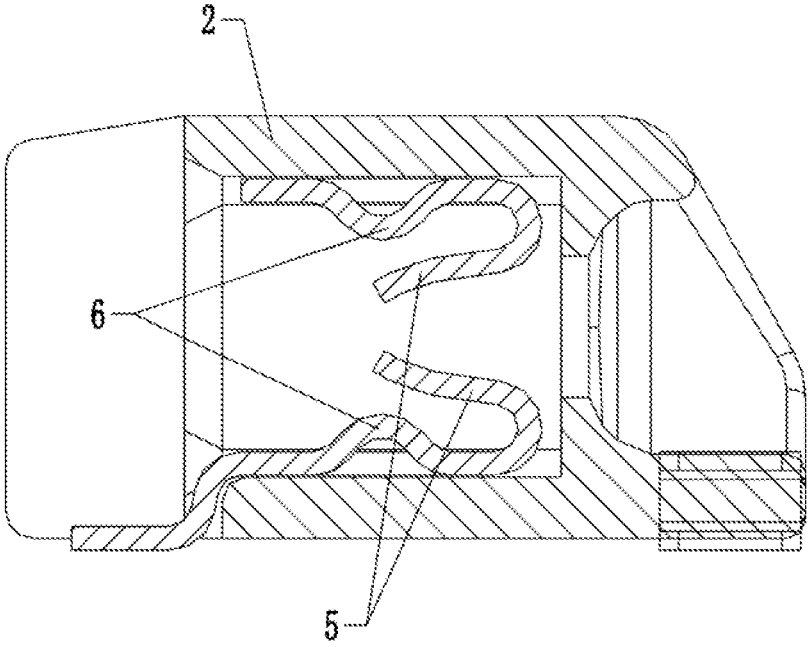
FIG. 4 is a sectional view showing a patch electrical connector of the first embodiment of the present disclosure.

As shown in FIG. 3 and FIG. 4, in one embodiment, the conductive seat 8 is provided with a support protrusion 6 located below the clamping pieces 5. Specifically, the supporting protrusion 6 is a protrusion disposed on the engaging section 10. In usage, the supporting protrusion 6 can limit the angle at which the clamping piece 5 is outwardly deflected to ensure that during frequent outward deflection, the angle at which the clamping piece 5 is outwardly deflected is prevented from becoming too large which otherwise would cause failure of clamping the wire or male connector. As shown in FIG. 3, in the embodiment, the support protrusion 6 is an arcuate convex structure.

Figure 5:
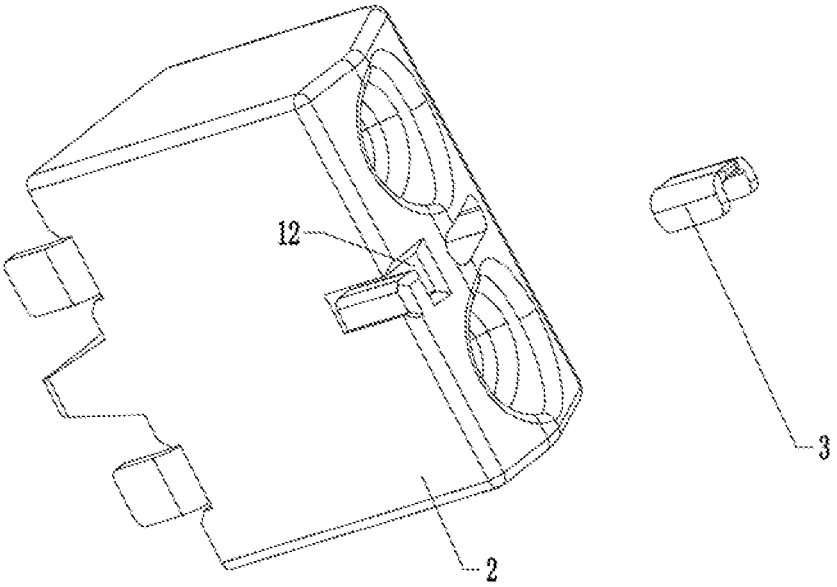
FIG. 5 is a partially exploded view of the patch electrical connector of the first embodiment of the present disclosure.
Figure 6:
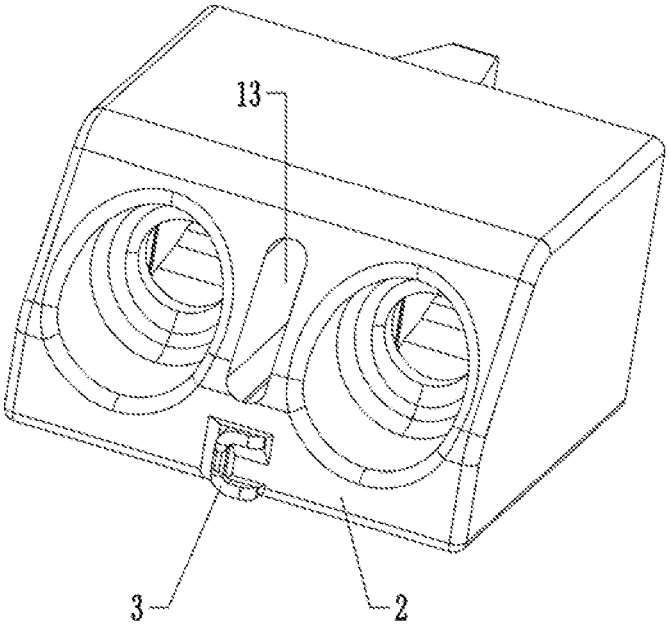
FIG. 6 is a second isometric view of the patch electrical connector of the first embodiment of the present disclosure.

As shown in FIG. 5 and FIG. 6, in one embodiment, the second weld leg 3 has a U-shaped geometry, and the housing 2 is provided with a connecting groove 12 adapted to the second weld leg 3, and the second weld leg 3 is laterally placed into the connecting groove 12. By the structure of the connecting groove 12 and the U-shaped second weld leg 3, the second weld leg 3 of the present disclosure can be conveniently mounted on the housing 2. Also, since the second weld leg 3 is a U-shaped body laterally placed on the housing 2, reliable connection of the second weld leg 3 and the housing 2 is ensured, and wire connection between the second weld leg 3 and the PCB is realized. In this way, welding between the second weld leg 3 and the PCB is improved, which further enhances the connection between the patch electrical connector and the PCB board.

Further, as shown in FIG. 2 and FIG. 5, in one embodiment, the first weld leg 7 and the second weld leg 3 are arranged one behind the other. The first weld leg 7 and the second weld leg 3 arranged one behind the other can facilitate the connection of the patch electrical connector to the PCB board.

Meanwhile, as shown in FIG. 3 and FIG. 4, in the embodiment, the end portions of the pair of clamping pieces 5 are respectively curved toward each other. Specifically, the pair of clamping pieces 5 of which the end portions are curved toward each other ensures that the wire or the male connector has sufficient contact area with the clamping pieces 5 when inserted. Also, it ensures that the clamping pieces 5 have good elastic resetting ability.

As shown in FIG. 6, in the specific implementation, a first groove 13 is centrally provided on the housing 2 between the two mounting cavities 4. Arrangement of the first groove 13 can not only reduce the material usage but also ensure that the housing 21 does not shrink at this point during injection molding.

Thus, the patch electrical connector of the present disclosure can be firmly connected to the PCB board while ensuring a simple structure, and therefore has good practicability.

Second Embodiment

Figure 7:
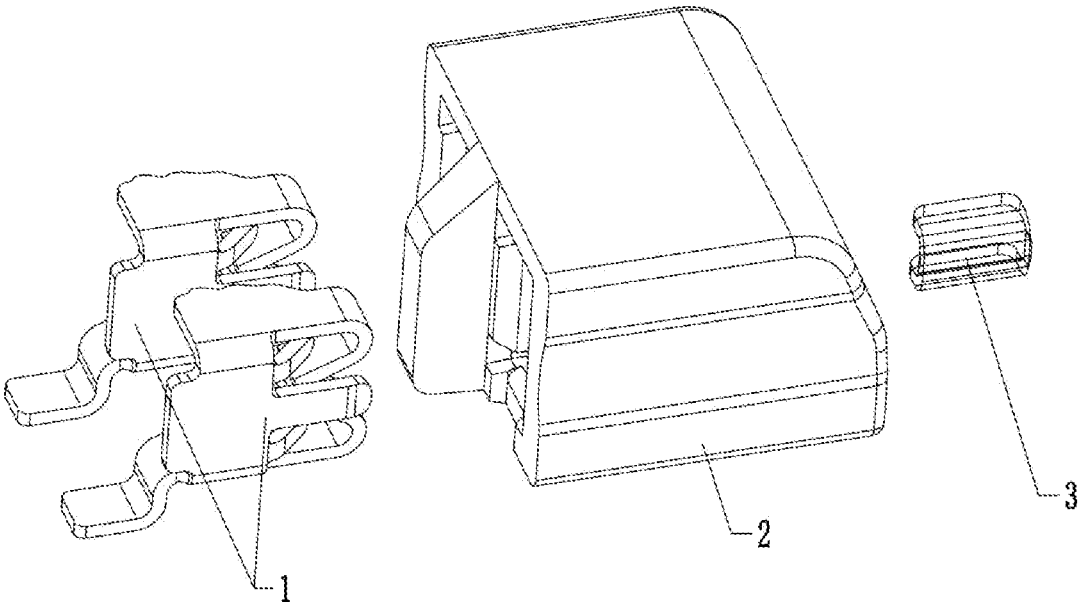
FIG. 7 is an exploded view of a patch electrical connector of a second embodiment of the present disclosure.
Figure 8:
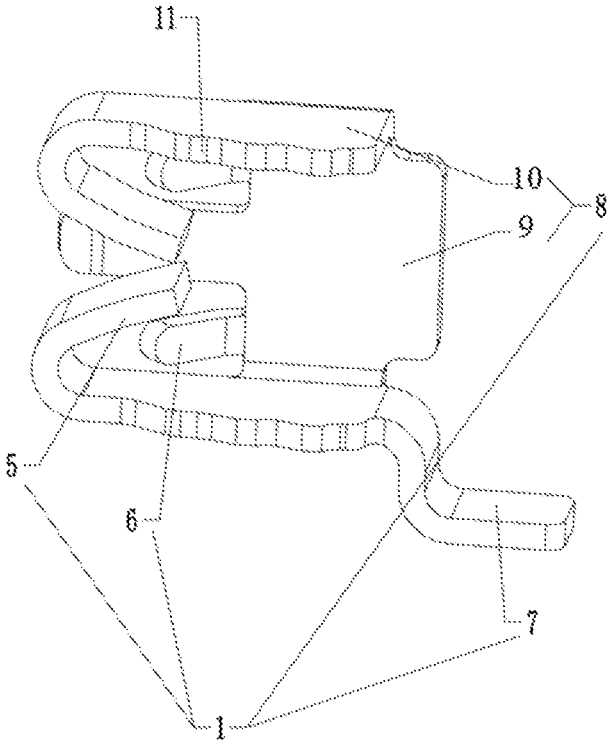
FIG. 8 is an isometric view of the conductive clip of the second embodiment of the present disclosure.
Figure 9:
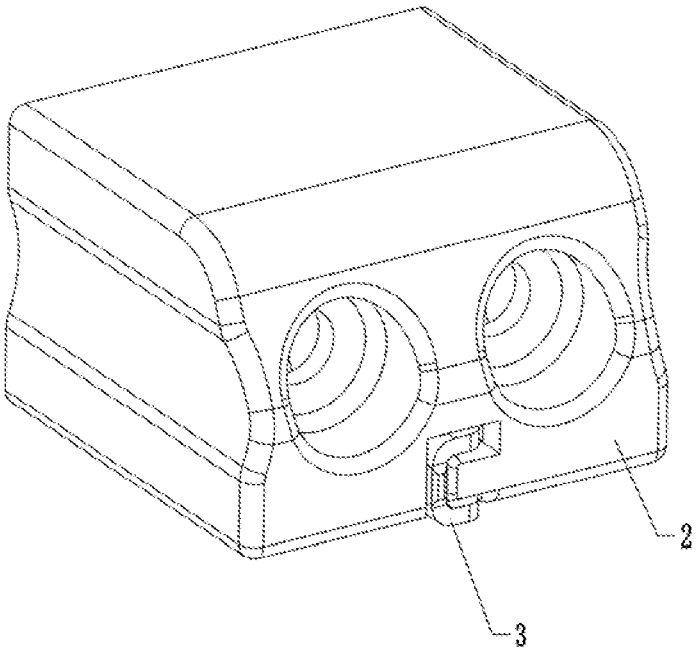
FIG. 9 is an isometric view of the patch electrical connector of the second embodiment of the present disclosure.
Figure 10:
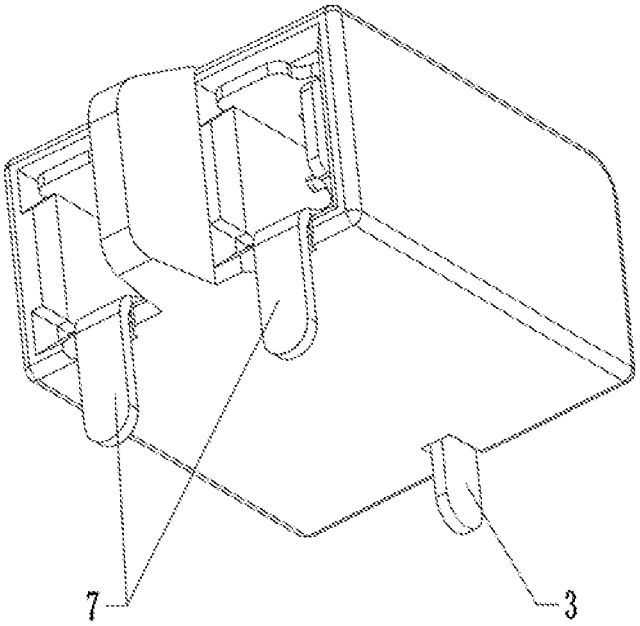
FIG. 10 is an isometric view of the patch electrical connector of a third embodiment of the present disclosure.
Figure 11:
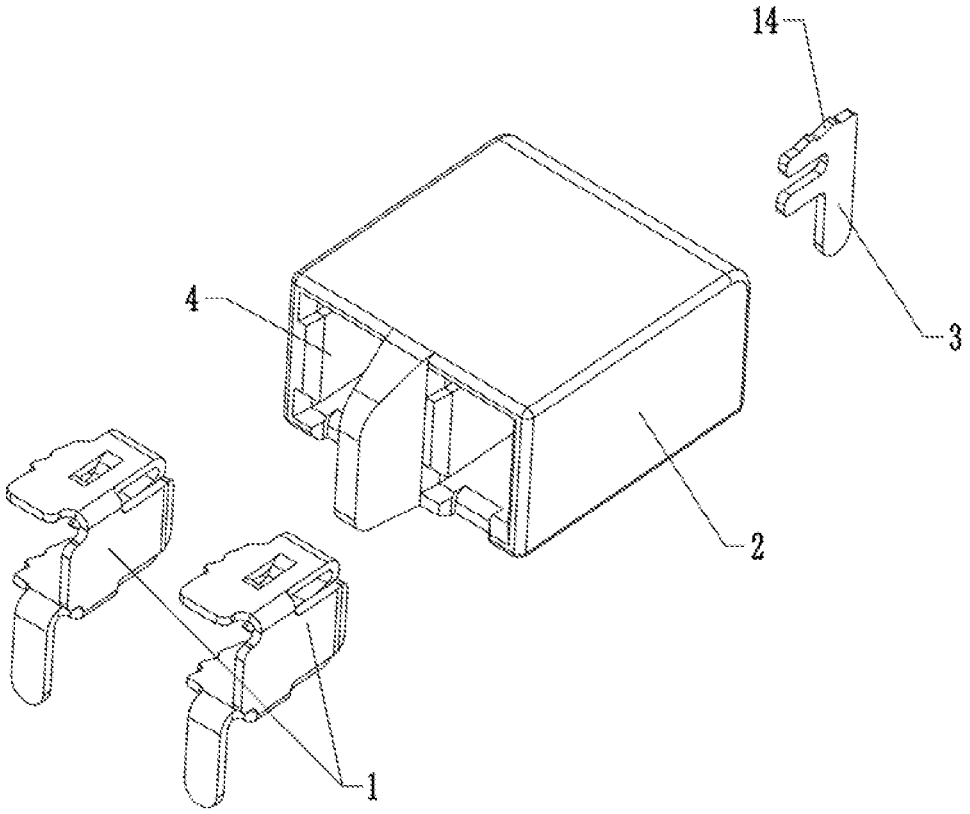
FIG. 11 is an exploded view of a patch electrical connector of the third embodiment of the present disclosure.
Figure 12:
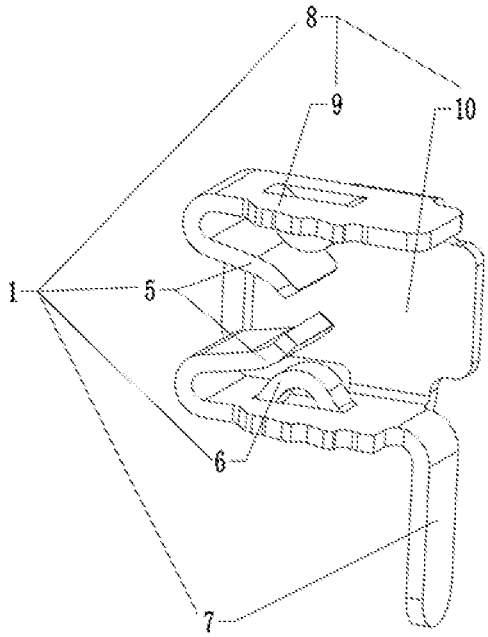
FIG. 12 is an isometric view of the conductive clip of the third embodiment of the present disclosure.
Figure 13:
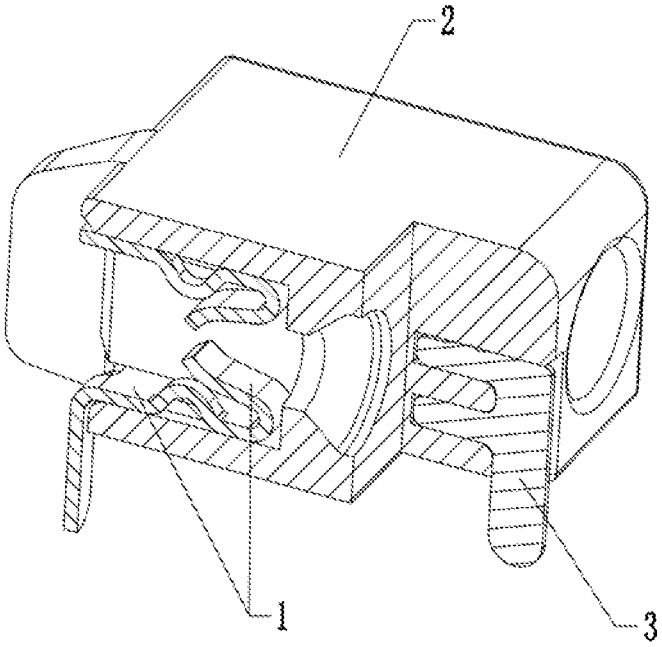
FIG. 13 is a sectional view showing a patch electrical connector of the third embodiment of the present disclosure.

As shown in FIG. 7 to FIG. 9, in one embodiment, the support protrusion 6 is an extension rod disposed in the intermediate section 9 and extending outwardly below the clamping piece 5. Further, the present embodiment does not need the first groove 13. In the present case, the housing 2, the second weld leg 3, and the remaining structures of the conductive clip 1 are the same as those of the first embodiment, and will not be described herein.

Third Embodiment

As shown in FIG. 10 to FIG. 13, in the embodiment, the second weld leg 3 is an F-shaped plate-shaped geometry, and the second weld leg 3 is provided with a second engaging portion 14. The second engaging portion 14 is a teeth structure, and the teeth structure of the second engaging portion 14 can be firmly engaged with the housing 2 so that the second weld leg 3 can be securely mounted in the mounting cavity 43. In another embodiment, the second weld leg 3 and the housing 2 may be integrally formed.

In the present case, the housing 2 and the remaining structures of the conductive clip 1 are the same as those of the first embodiment, and will not described herein. Of course, it should be noted that, in the present case, the housing 2 may need to be correspondingly designed in a conventional way in order to be matched with the second weld leg 3, and the details will not described herein.

The above is only some embodiments of the present disclosure, and is not intended to limit the present disclosure. To those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. A patch electrical connector for electrical connection to a PCB board, the patch electrical connector comprising:

a housing having at least one mounting cavity provided therein;

a conductive clip adapted in each of the at least one mounting cavity, the conductive clip comprising a conductive seat provided in the at least one mounting cavity, at least one pair of clamping pieces electrically connected to the conductive seat, and a first weld leg electrically connected to the conductive seat and welded to the PCB board; and a second weld leg having one end welded to the PCB board and another end disposed in the housing opposite to the first weld leg;

wherein a wire or male connector is insertable into the at least one mounting cavity and clamped to the at least one pair of the clamping pieces to enable electric communication with the PCB;

wherein the conductive seat comprises an intermediate section and a pair of engaging sections electrically connected to two sides of the intermediate section, the engaging sections are used for engagement with the housing, and the at least one pair of clamping pieces are electrically connected to the engaging sections;

the conductive clip comprises a support protrusion provided at the intermediate section, and located below the at least one pair of clamping pieces; and the support protrusion is an extension rod disposed in the intermediate section and extending outwardly below the clamping piece.

2. The patch electrical connector of claim 1, wherein the engaging section is provided with a first engaging portion having a teeth shape, the second weld leg is provided with a second engaging portion having a teeth shape, and both the conductive clip and the second weld leg are engaged with the housing.

3. The patch electrical connector of claim 1, wherein the second weld leg has a U-shaped geometry, and the housing is provided with a connecting groove adapted to the second weld leg, and the second weld leg is laterally placed in the connecting groove.

4. The patch electrical connector of claim 1, wherein the first weld leg and the second weld leg are arranged one behind the other.

5. The patch electrical connector of claim 1, wherein end sections of the at least one pair of the clamping pieces are respectively curved toward each other.

6. The patch electrical connector of claim 1, wherein the second weld leg is an F-shaped plate-shaped geometry, and the second weld leg is provided with a second engaging portion; the second engaging portion is a teeth structure, and the teeth structure of the second engaging portion firmly is engaged with the housing so that the second weld leg is securely mounted in the mounting cavity.

7. The patch electrical connector of claim 1, wherein a first groove is centrally provided on the housing between two of the mounting cavities.

* * * * *